US006634406B2

(12) United States Patent
Burgess et al.

(10) Patent No.: US 6,634,406 B2
(45) Date of Patent: Oct. 21, 2003

(54) MINI BLIND APPARATUS

(75) Inventors: Steve Burgess, Madison, WI (US); Brian W. Smith, Evansville, WI (US)

(73) Assignee: Advanced Innovations, LLC, Reedsburg, WI (US)

( * ) Notice: Subject to any disclaimer, the term of this patent is extended or adjusted under 35 U.S.C. 154(b) by 0 days.

(21) Appl. No.: 10/046,462

(22) Filed: Jan. 14, 2002

(65) Prior Publication Data

US 2003/0131950 A1 Jul. 17, 2003

(51) Int. Cl.[7] ..... E06B 9/30

(52) U.S. Cl. ..... 160/176.1 R; 160/178.3 R

(58) Field of Search ..... 160/168.1 R, 172 R, 160/173 R, 178.1 R, 178.3 R, 176.1 R

(56) References Cited

U.S. PATENT DOCUMENTS

| | | | | |
|---|---|---|---|---|
| 3,170,505 A | * | 2/1965 | Lorentzen et al. | 160/178.3 R |
| 3,332,471 A | * | 7/1967 | Croxen | 160/178.3 R |
| 3,682,752 A | * | 8/1972 | Hunter et al. | 160/178.3 R |
| 5,597,027 A | * | 1/1997 | Simon et al. | 160/178.3 R |

* cited by examiner

*Primary Examiner*—David Purol
(74) *Attorney, Agent, or Firm*—David J. Archer

(57) ABSTRACT

A mini blind apparatus is disclosed. The apparatus includes a first slat having a first and a second end and a front and a rear edge. A second slat is disposed spaced and parallel relative to the the first slat, the second slat having a first and a second extremity and a front and a rear side. A control mechanism is connected to the slats for controlling movement of the slats. The spaced disposition of the slats is selectively controlled by the control mechanism. The control mechanism includes a supporting polyester tape connected to the slats.

14 Claims, 10 Drawing Sheets

MINI BLIND APPARATUS

BACKGROUND OF THE INVENTION

1. Field of the Invention

The present invention relates to a mini blind apparatus. More specifically, the present invention relates to a mini blind apparatus having a plurality of parallel spaced horizontally disposed slats.

2. Background Information

Mini blinds typically include a plurality of parallel spaced slats connected to each other by control cords which not only control the elevation of the slats but also control the inclination of the slats relative to each other.

Such control cords for controlling the inclination of the slats usually have a ladder shaped configuration with a front and a rear rail having a plurality of rungs extending between the rails. The arrangement is such that the lateral ends of each slat is supported on a corresponding rung of the ladder. When the rails are moved relatively to each other, the rungs are tilted thus controlling the inclination of the slats.

However, the manufacture of the aforementioned ladder controls is relatively complex. Also, the threading of the slats into the space formed between adjacent rungs of the ladder control is labor intensive.

The present invention simplifies the manufacture of control cords by the manufacture of such cords from polyester material.

Additionally, the present invention provides a unique arrangement for controlling the inclination of the slats of a mini blind apparatus by the provision of tabs secured to the slats, such tabs including anchoring spools.

Therefore, it is a primary feature of the present invention to provide a control cord that overcomes the problems associated with the prior art arrangements.

A further feature of the present invention is the provision of a mini blind apparatus which simplifies the manufacture of such mini blinds.

Another feature of the present invention is the provision of a mini blind apparatus that includes tabs for supporting the slats and spools secured to control tapes for tilting the slats.

Other features and advantages of the present invention will be readily apparent to those skilled in the art by a consideration of the detailed description taken in conjunction with the annexed drawings.

SUMMARY OF THE INVENTION

The present invention relates to a mini blind apparatus is disclosed which includes a first slat having a first and a second end and a front and a rear edge. A second slat is disposed spaced and parallel relative to the the first slat, the second slat having a first and a second extremity and a front and a rear side. A control mechanism is connected to the slats for controlling movement of the slats. The spaced disposition of the slats is selectively controlled by the control mechanism. The control mechanism includes a supporting polyester tape which is connected to the slats.

In a more specific embodiment of the present invention, the slats are disposed horizontally and the polyester tape is of rectangular cross sectional configuration.

Additionally, the mini blind apparatus includes a first tab having a front and a rear end, the front end of the tab being secured to the rear edge of the first slat. The first tab includes a first member which definines a first aperture and a second aperture disposed between the first aperture and the rear end of the tab. A second member is disposed spaced and parallel relative to the first member and the second member defines a first hole which is aligned relative to the first aperture. A second hole of the second member is aligned relative to the second aperture and is disposed between the first hole and the rear end of the tab.

Furthermore, a first spool is disposed between the first aperture and the first hole, the first spool defining a first orifice which is aligned relative to the first aperture and the first hole.

Moreover, a first pin extends through the first aperture, the first orifice and the first hole for rotatably supporting the first spool between the first and second members.

A second spool is disposed between the second aperture and the second hole, the second spool defining a second orifice which is aligned relative to the second aperture and the second hole.

Also, a second pin extends through the second aperture, the second orifice and the second hole for rotatably supporting the second spool between the first and second members.

Additionally, the first spool defines a first slot and the second spool defines a second slot. The control mechanism includes a first and a second polyester tape, the first tape extending through the first slot of the first spool and the second tape extending through the second slot of the second spool.

The first spool includes a first cylindrical body which defines the first slot, the first body having a first and a second end. The first slot extends diametrically through the first body transverse relative to the first orifice such that when the first tape extends through the first slot and the first pin is inserted through the first orifice, the first tape is wedged between the first pin and the first orifice.

Moreover, the second spool includes a second cylindrical body which defines the second slot, the second body having a first and a second extremity. The second slot extends diametrically through the second body transverse relative to the second orifice such that when the second tape extends through the second slot and the second pin is inserted through the second orifice, the second tape is wedged between the second pin and the second orifice.

The first orifice is serrated such that wedging of the first tape is enhanced. Also, the second orifice is serrated such that wedging of the second tape is enhanced.

Additionally, the first spool further includes a first flange which extends from the first end of the first body and a second flange extends from the second end of the first body.

Furthermore, the second spool further includes a first annular extension which extends from the first extremity of the second body. A second annular extension extends from the second extremity of the second body.

The first pin has a first and a second end, the second end of the first pin defining a first point. Also, the second pin has a first and a second extremity, the second extremity of the second pin defining a second point. The arrangement is such that when the pins have been inserted into the orifices, the points are snipped off.

More specifically, the pins are metal and the slots are beveled at the ends thereof to facilitate threading therethrough of the tapes.

The first tab further includes a frangible spacer which is disposed adjacent to the rear end of the first tab, the spacer being removed from the first tab after the pins are inserted through the orifices.

Additionally, the first and second spools define first and second flattened portions which are disposed diametrically opposite to each other in order to assist location of the spools during threading thereof.

Many modifications and variations of the present invention will be apparent to those skilled in the art from the detailed description of a preferred embodiment of the present invention contained hereinafter. However, such modifications and variations fall within the spirit and scope of the present invention as defined by the appended claims.

BRIEF DESCRIPTION OF THE DRAWINGS

Similar reference numerals refer to similar parts throughout the various views of the drawings.

DETAILED DESCRIPTION OF THE DRAWINGS

Figure 1:
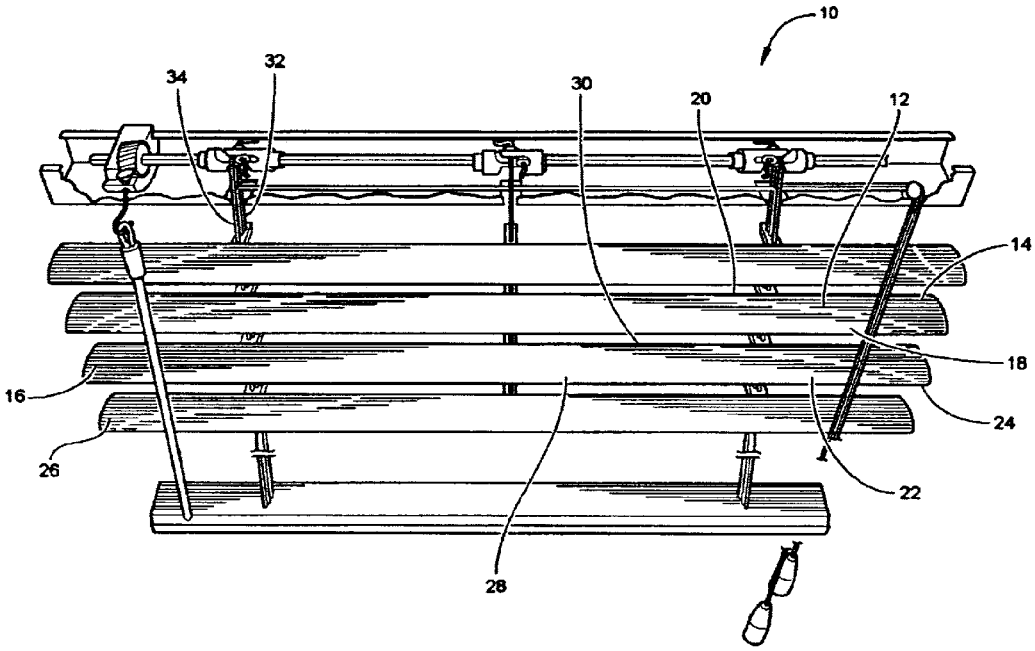
FIG. 1 is a perspective view of a mini blind apparatus according to the present invention.

FIG. 1 is a perspective view of a mini blind apparatus generally designated 10 according to the present invention as shown in FIG. 1, the apparatus 10 includes a first slat 12 having a first and a second end 14 and 16 respectively and a front and a rear edge 18 and 20 respectively. A second slat 22 is disposed spaced and parallel relative to the the first slat 12, the second slat 22 having a first and a second extremity 24 and 26 respectively and a front and a rear side 28 and 30 respectively. A control mechanism 32 is connected to the slats 12 and 22 respectively for controlling movement of the slats 12 and 22. The spaced disposition of the slats 12 and 22 is selectively controlled by the control mechanism 32. The control mechanism 32 includes a supporting polyester tape 34 connected to the slats 12 and 22.

As shown in FIG. 1, the slats 12 and 22 are disposed horizontally and the polyester tape 34 is of rectangular cross sectional configuration.

Figure 2:
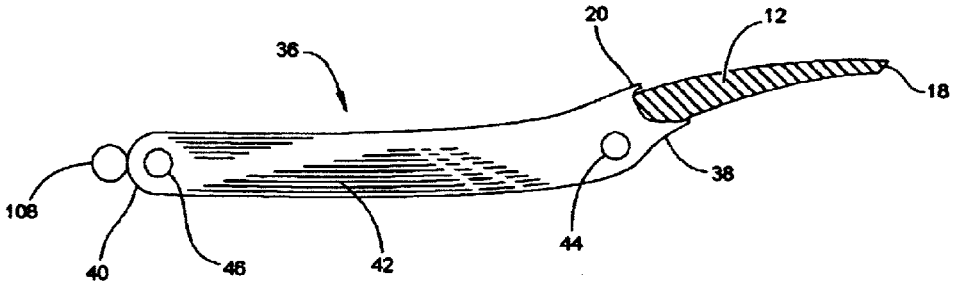
FIG. 2 is an enlarged side elevational view of the slat shown in FIG. 1.

FIG. 2 is an enlarged side elevational view of the slat 12 shown in FIG. 1. As shown in FIG. 2, a first tab generally designated 36 has a front and a rear end 38 and 40 respectively, the front end 38 of the tab 36 being secured to the rear edge 20 of the first slat 12. The first tab 36 includes a first member 42 which defines a first aperture 44 and a second aperture 46 disposed between the first aperture 44 and the rear end 40 of the tab 36.

Figure 3:
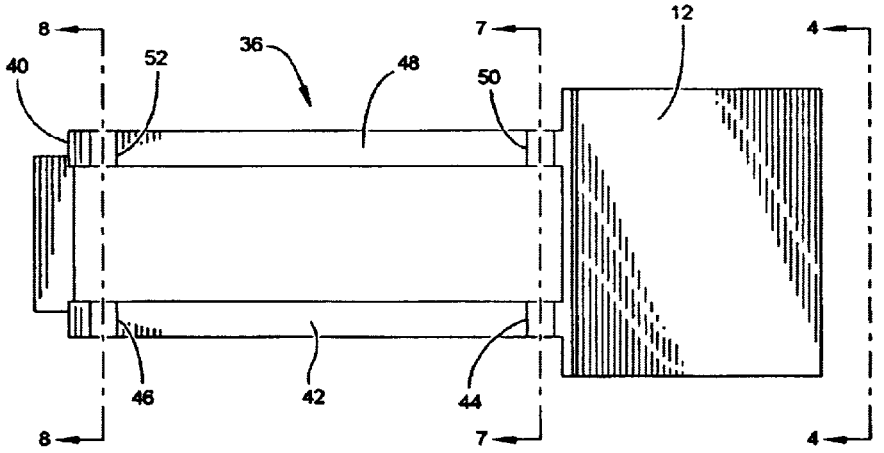
FIG. 3 is a view taken on the line 3—3 of FIG. 2.

FIG. 3 is a view taken on the line 3—3 of FIG. 2. As shown in FIG. 3, a second member 48 is disposed spaced and parallel relative to the first member 42 and the second member 48 defines a first hole 50 which is aligned relative to the first aperture 44. A second hole 52 is aligned relative to the second aperture 46 and is disposed between the first hole 50 and the rear end 40 of the tab 36.

Figure 4:
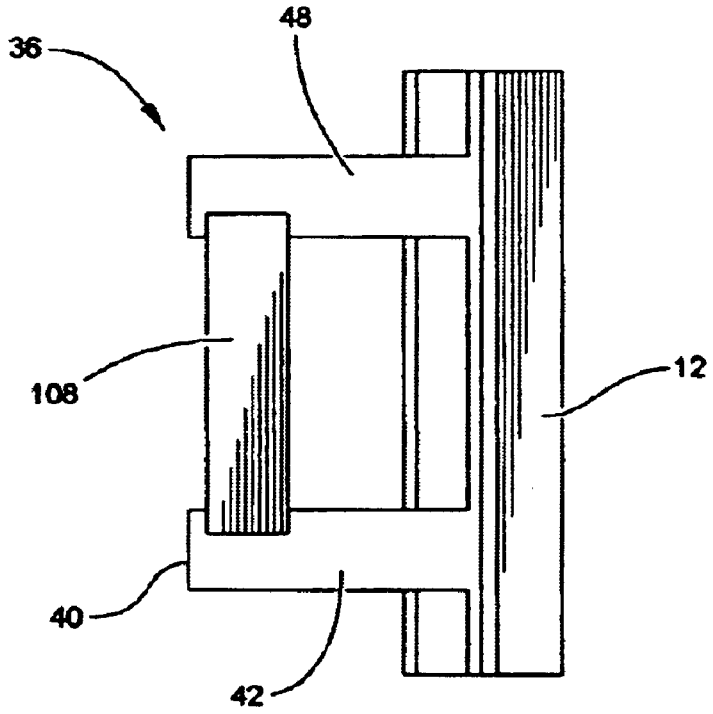
FIG. 4 is a view taken on the line 4—4 of FIG. 3.

FIG. 4 is a view taken on the line 4—4 of FIG. 3. As shown in FIG. 4, the members 42 and 48 are spaced relative to each other.

Figure 5:
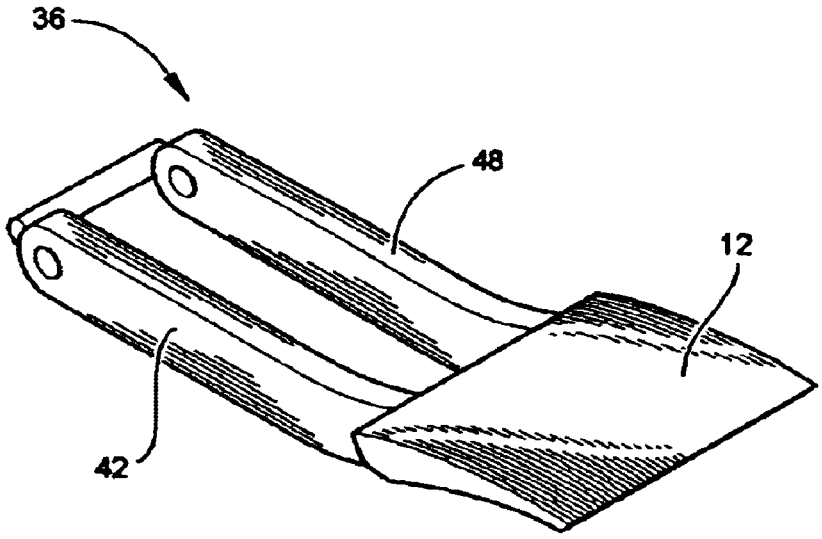
FIG. 5 is a perspective view on a reduced scale of the combined tab and slat.

FIG. 5 is a perspective view on a reduced scale of the combined tab 36 and slat 12.

Figure 6:
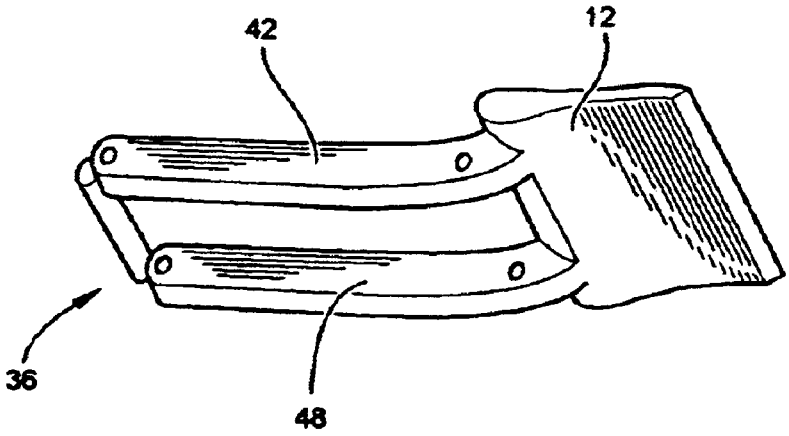
FIG. 6 is a perspective view on a reduced scale of the combined tab and slat as shown in FIG. 5 but viewed from slightly below.

FIG. 6 is a perspective view on a reduced scale of the combined tab 36 and slat 12 as shown in FIG. 5 but viewed from slightly below.

Figure 7:
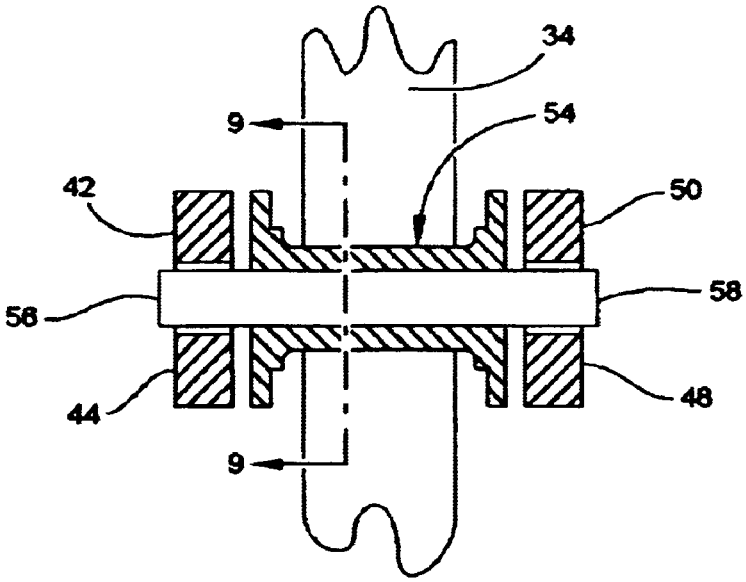
FIG. 7 is a sectional view taken on the line 7—7 of FIG. 3.

FIG. 7 is a sectional view taken on the line 7—7 of FIG. 3. As shown in FIG. 7, a first spool generally designated 54 is disposed between the first aperture 44 and the first hole 50 of the members 42 and 48 respectively, the first spool 54 defining a first orifice 56 which is aligned relative to the first aperture 44 and the first hole 50. The spool 54 is disposed between the members 42 and 48 and a first pin 58 extends through the first aperture 44, the first orifice 56 and the first hole 50 for rotatably supporting the first spool 54 between the first and second members 42 and 48 respectively.

Figure 8:
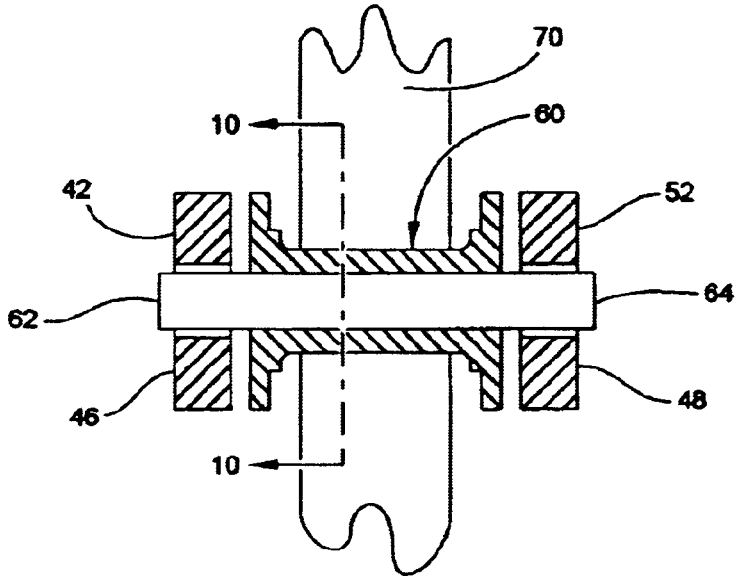
FIG. 8 is a sectional view taken on the line 8—8 of FIG. 3.

FIG. 8 is a sectional view taken on the line 8—8 of FIG. 3. As shown in FIG. 8, a second spool generally designated 60 is disposed between the second aperture 46 and the second hole 52 of the members 42 and 48 respectively. The second spool 60 defines a second orifice 62 which is aligned relative to the second aperture 46 and the second hole 52.

Also, a second pin 64 extends through the second aperture 46, the second orifice 62 and the second hole 52 for rotatably supporting the second spool 60 between the first and second members 42 and 48 respectively.

Figure 9:
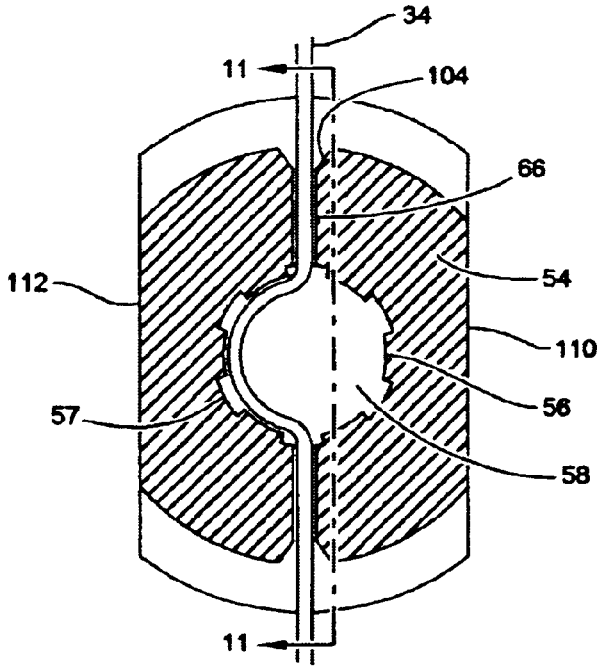
FIG. 9 is an enlarged sectional view taken on the line 9—9 of FIG. 7.

FIG. 9 is an enlarged sectional view taken on the line 9—9 of FIG. 7 and shows the first spool 54. As shown in FIG. 9, the first spool 54 defines a first slot 66.

Figure 10:
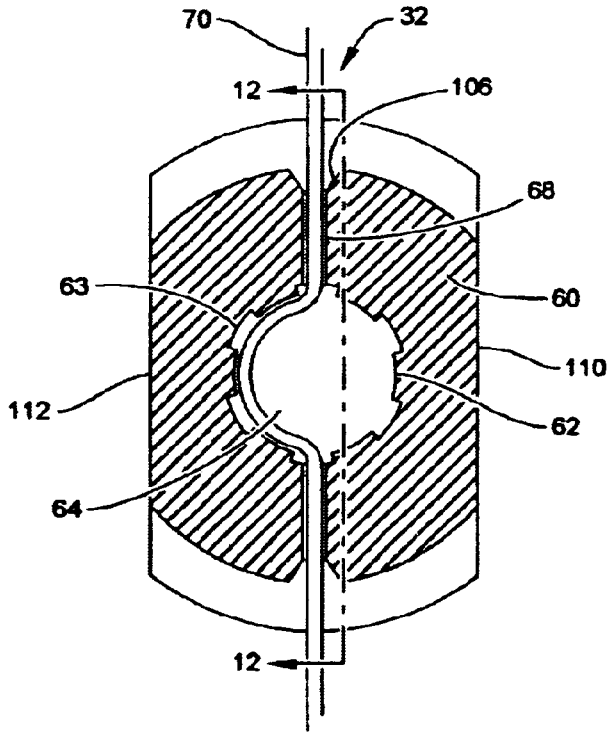
FIG. 10 is an enlarged view taken on the line 10—10 of FIG. 7.

FIG. 10 is an enlarged view taken on the line 10—10 of FIG. 8. As shown in FIG. 10, the second spool 60 defines a second slot 68. The control mechanism 32 includes the first and a second polyester tape 34 and 70 respectively, the first tape 34 extending through the first slot 66 of the first spool 54 as shown in FIG. 9 and the second tape 70 extending through the second slot 68 of the second spool 60 as shown in FIG. 10.

Figure 11:
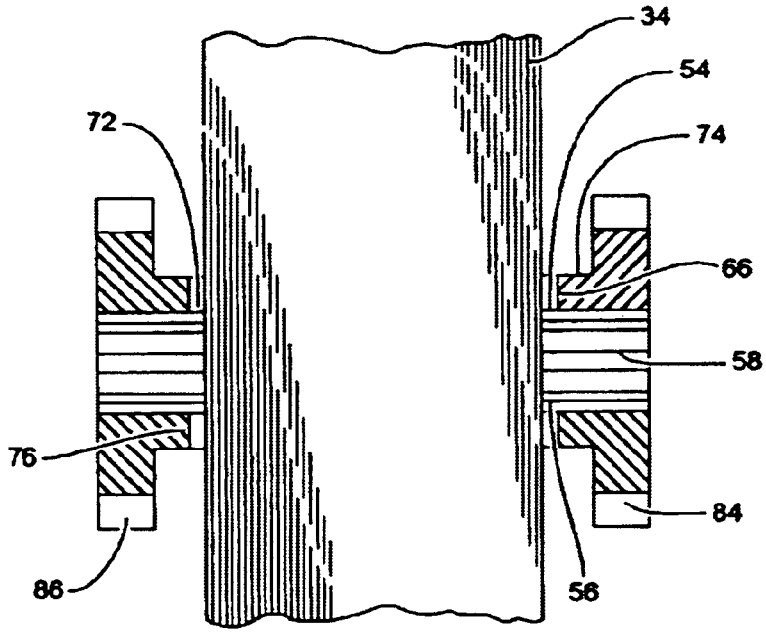
FIG. 11 is a view taken on the line 11—11 of FIG. 9.

FIG. 11 is a view taken on the line 11—11 of FIG. 9. As shown in FIG. 11, the first spool 54 includes a first cylindrical body 72 which defines the first slot 66, the first body 72 having a first and a second end 74 and 76 respectively. The first slot 66 extends diametrically through the first body 72 transversely relative to the first orifice 56 such that when the first tape 34 extends through the first slot 66 and the first pin 58 is inserted through the first orifice 56, the first tape 34 is wedged between the first pin 58 and the first orifice 56 as shown in FIG. 9.

Figure 12:
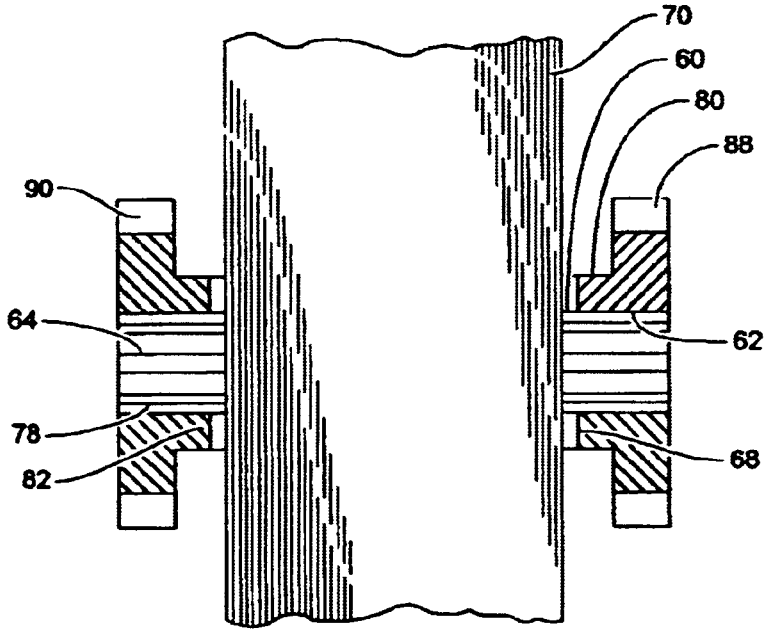
FIG. 12 is a view taken on the line 12—12 of FIG. 10.

FIG. 12 is a view taken on the line 12—12 of FIG. 10. As shown in FIG. 12, the second spool 60 includes a second cylindrical body 78 which defines the second slot 68, the second body 78 having a first and a second extremity 80 and 82 respectively. The second slot 68 extends diametrically through the second body 78 transversely relative to the second orifice 62 such that when the second tape 70 extends through the second slot 68 and the second pin 64 is inserted through the second orifice 62, the second tape 70 is wedged between the second pin 64 and the second orifice 62 as shown in FIG. 10.

As shown in FIG. 9, the first orifice 56 is serrated at 57 such that wedging of the first tape 34 is enhanced. Also, as shown in FIG. 10, the second orifice 62 is serrated at 63 such that wedging of the second tape 70 is enhanced.

Additionally, as shown in FIG. 11, the first spool 54 further includes a first flange 84 which extends from the first end 74 of the first body 72. A second flange 86 extends from the second end 76 of the first body 72.

Furthermore, as shown in FIG. 12, the second spool 60 further includes a first annular extension 88 which extends from the first extremity 80 of the second body 78. A second annular extension 90 extends from the second extremity 82 of the second body 78.

Figure 13:
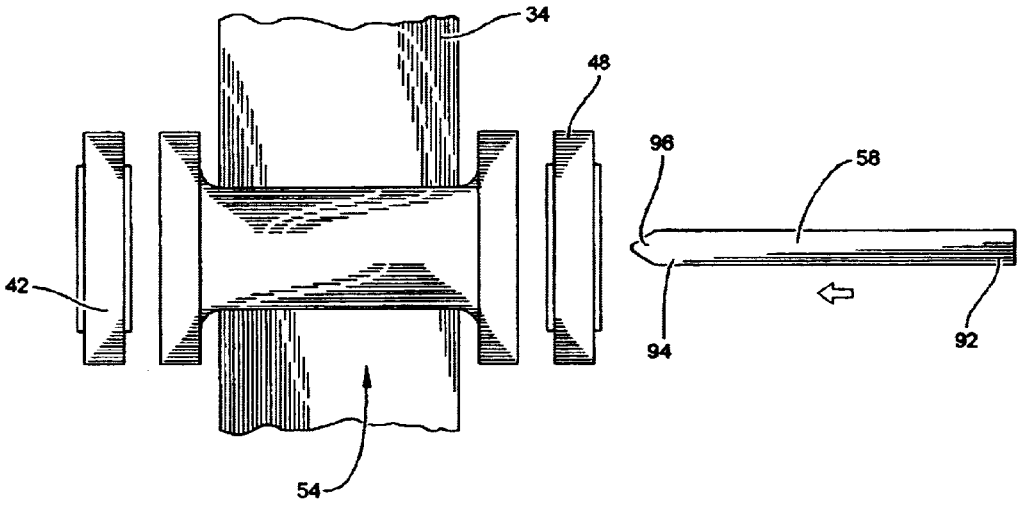
FIG. 13 is a side elevational view of the first spool.

FIG. 13 is a side elevational view of the first spool 54. As shown in FIG. 13, the first pin 58 has a first and a second end 92 and 94 respectively, the second end 94 of the first pin 58 defining a first point 96.

Figure 14:
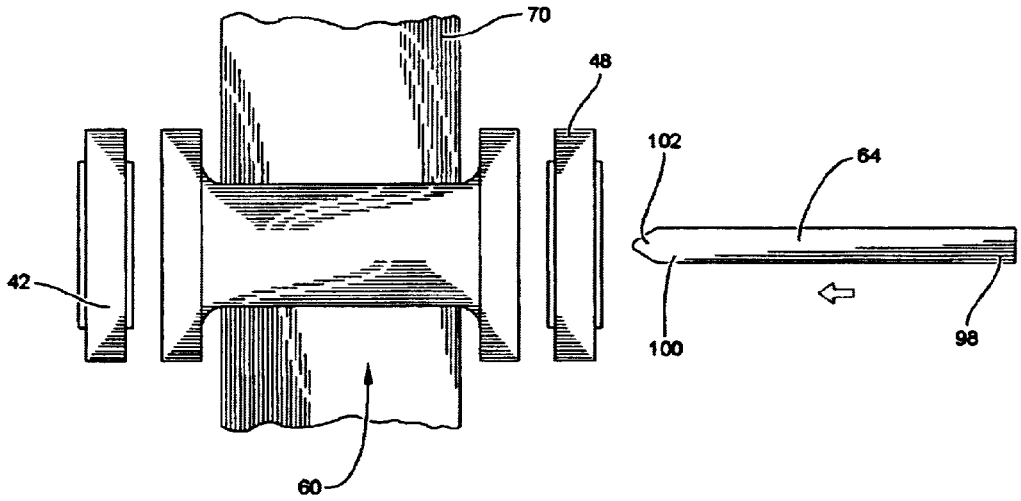
FIG. 14 is a side elevational view of the second spool.

FIG. 14 is a side elevational view of the second spool 60. As shown in FIG. 14, the second pin 64 has a first and a second extremity 98 and 100 respectively, the second extremity 100 of the second pin 64 defining a second point 102.

Figure 15:
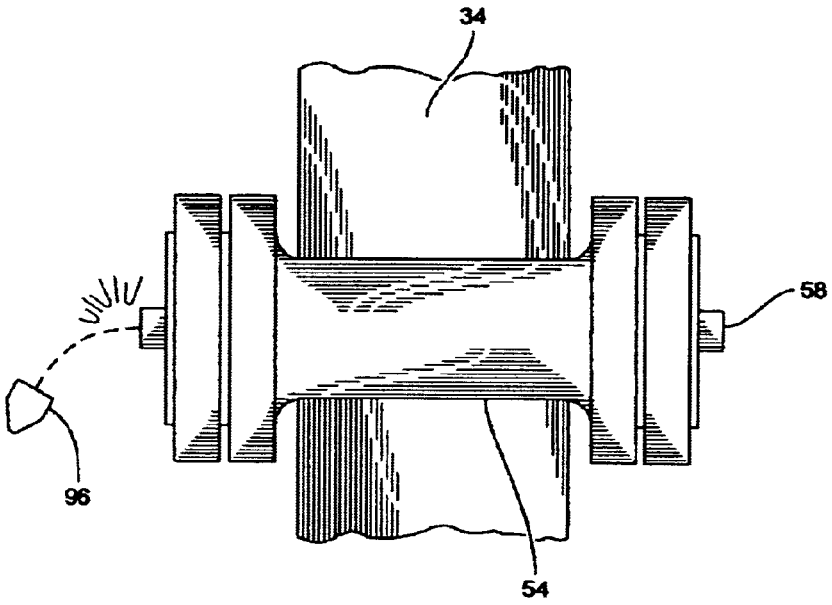
FIG. 15 is a view of the arrangement shown in FIG. 13.

FIG. 15 is a view of the arrangement shown in FIG. 13. As shown in FIG. 15, the arrangement is such that when the pin 58 has been inserted in the orifice 56, the point 96 is snipped off.

More specifically, the pins 58 and 64 are metal and as shown in FIGS. 9 and 10, the slots 66 and 68 are beveled at the ends thereof at 104 and 106 respectively to facilitate threading therethrough of the tapes 34 and 70 respectively.

As shown in FIG. 2, the first tab 36 further includes a frangible spacer 108 which is disposed adjacent to the rear end 40 of the first tab 36, the spacer 108 being removed from the first tab 36 after the pins 58 and 64 have been inserted through the orifices 56 and 62 respectively.

Additionally, as shown in FIG. 9, the first spool 54 defines first and second flattened portions 110 and 112 respectively which are disposed diametrically opposite to each other in order to assist location of the spool 54 during threading thereof. As shown in FIG. 10, the second spool 60 also includes flattened portions 110 and 112 for the same reason.

Figure 16:
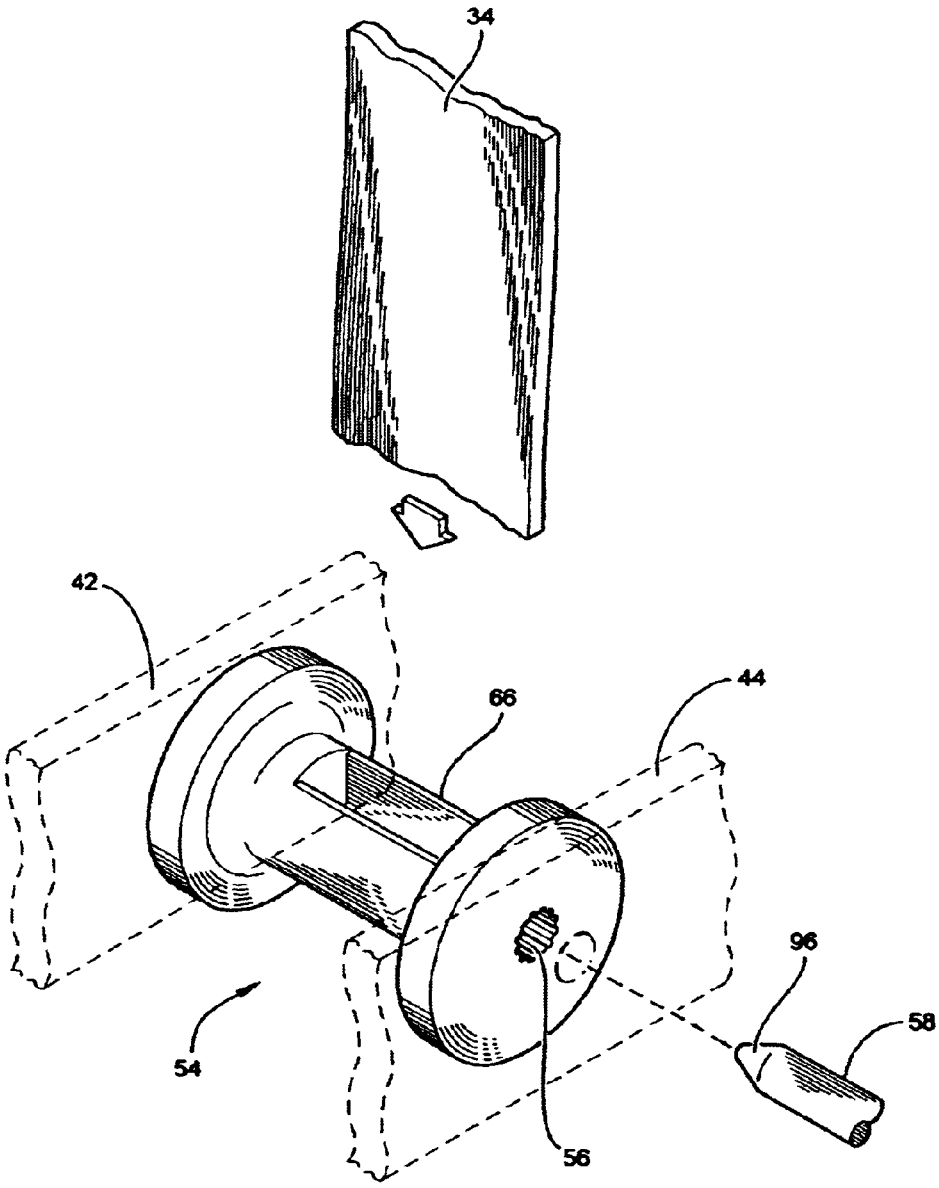
FIG. 16 is a perspective view showing the threading of the tape the slot.

FIG. 16 is a perspective view showing the threading of the tape 34 through the slot 66 of the spool 54 and the pin 58 being inserted through the orifice 56.

In operation of the mini blind apparatus according to the present invention, the tape 34 is threaded through the slot 66 of the the first spool 54 and through all the other slots corresponding to the number slats used in the mini blind. The spool 54 is then located between the members 42 and 48 and the pin 58 is inserted through through the aperture 44, orifice 56 and hole 50 so that the tape 34 is wedged at the correct disposition relative to the tab 36.

The same procedure is followed for the second spool 60. When all of the spools have been located, relative parallel movement between the tapes 34 and 70 will tilt the inclination of each of the slats.

Also, each of the slats is provided with corresponding tabs as described relative to the first slat 12. Furthermore, each slat will be provided with at least two tabs for supporting the slat.

The present invention provides a unique arrangement for assembling a mini blind apparatus that is relatively inexpensive and simple to construct.

What is claimed is:

1. A mini blind apparatus comprising:

a first slat having a first and a second end and a front and a rear edge;

a second slat disposed spaced and parallel relative to said first slat, said second slat having a first and a second extremity and a front and a rear side;

a control mechanism connected to said slats for controlling movement of said slats;

a spaced disposition of said slats being selectively controlled by said control mechanism;

said control mechanism including:

a supporting polyester tape connected to said slats; said slats being disposed horizontally;

said polyester tape being of rectangular cross sectional configuration;

a first tab secured to said rear edge of said first slat a first spool rotatable secured to said first tab, said supporting tape extending through said first spool, said spaced disposition of said slats being controlled by movement of said tape by said control mechanism.

2. A mini blind apparatus comprising:

a first slat having a first and a second end and a front and a rear edge;

a second slat disposed spaced and parallel relative to said first slat, said second slat having a first and a second extremity and a front and a rear side;

a control mechanism connected to said slats for controlling movement of said slats;

a spaced disposition of said slats being selectively controlled by said control mechanism;

said control mechanism including:

a supporting polyester tape connected to said slats;

a first tab having a front and a rear end, said front end of said tab being secured to said rear edge of said first slat;

said first tab including:

a first member defining a first aperture and a second aperture disposed between said first aperture and said rear end of said tab; and a second member disposed spaced and parallel relative to said first member, said second member defining a first hole aligned relative to said first aperture and a second hole aligned relative to said second aperture and disposed between said first hole and said rear end of said tab.

3. A mini blind apparatus as set forth in claim 2 further including:

a first spool disposed between said first aperture and said first hole, said first spool defining a first orifice which is aligned relative to said first aperture and said first hole;

a first pin extending through said first aperture, said first orifice and said first hole for rotatably supporting said first spool between said first and second members;

a second spool disposed between said second aperture and said second hole, said second spool defining a second orifice which is aligned relative to said second aperture and said second hole;

a second pin extending through said second aperture, said second orifice and said second hole for rotatably supporting said second spool between said first and second members.

4. A mini blind apparatus as set forth in claim 3 wherein said first spool defines a first slot;

said second spool defines a second slot;

said supporting polyester tape including:

a first and a second polyester tape;

said first tape extending through said first slot of said first spool;

said second tape extending through said second slot of said second spool.

5. A mini blind apparatus as set forth in claim 4 wherein said first spool includes:

a first cylindrical body which defines said first slot, said first body having a first and a second end;

said first slot extending diametrically through said first body transversely relative to said first orifice such that when said first tape extends through said first slot and said first pin is inserted through said first orifice, said first tape is wedged between said first pin and said first orifice;

said second spool includes:

a second cylindrical body which defines said second slot, said second body having a first and a second extremity;

said second slot extending diametrically through said second body transversely relative to said second orifice such that when said second tape extends through said second slot and said second pin is inserted through said second orifice, said second tape is wedged between said second pin and said second orifice.

6. A mini blind apparatus as set forth in claim 5 wherein said first orifice is serrated such that wedging of said first tape is enhanced;

said second orifice is serrated such that wedging of said second tape is enhanced.

7. A mini blind apparatus as set forth in claim 5 wherein said first spool further includes:

a first flange extending from said first end of said first body;

a second flange extending from said second end of said first body;

said second spool further including:

a first annular extension extending from said first extremity of said second body;

a second annular extension extending from said second extremity of said second body.

8. A mini blind apparatus as set forth in claim 3 wherein said first pin has a first and a second end, said second end of said first pin defining a first point;

said second pin has a first and a second extremity, said second extremity of said second pin defining a second point, the arrangement being such that when said pins have been inserted in said orifices, said points are snipped off.

9. A mini blind apparatus as set forth in claim 5 wherein said pins are metal.

10. A mini blind apparatus as set forth in claim 5 wherein said slots are beveled at said ends thereof to facilitate threading therethrough of said tapes.

11. A mini blind apparatus as set forth in claim 5 wherein said first tab further includes:

a frangible spacer disposed adjacent to said rear end of said first tab, said spacer being removed from said first tab after said pins are inserted through said orifices.

12. A mini blind apparatus as set forth in claim 5 wherein said first and second spools define first and second flattened portions which are disposed diametrically opposite to each other in order to assist location of said spools during threading thereof.

13. A mini blind apparatus comprising:

a first slat having a first and a second end and a front and a rear edge;

a second slat disposed spaced and parallel relative to said first slat, said second slat having a first and a second extremity and a front and a rear side;

a control mechanism connected to said slats for controlling movement of said slats;

a spaced disposition of said slats being selectively controlled by said control mechanism;

said control mechanism including:

a supporting polyester tape connected to said slats;

a first tab having a front and a rear end, said front end of said tab being secured to said rear edge of said first slat;

said first tab including:

a first member defining a first aperture and a second aperture disposed between said first aperture and said rear end of said tab;

a second member disposed spaced and parallel relative to said first member, said second member defining a first hole aligned relative to said first aperture and a second hole aligned relative to said second aperture and disposed between said first hole and said rearend of said tab;

a first spool disposed between said first aperture and said first hole, said first spool defining a first orifice which is aligned relative to said first aperture and said first hole;

a first pin extending through said first aperture, said first orifice and said first hole for rotatable supporting said first spool between said first and second members;

a second spool disposed between said second aperture and said second hole, said second spool defining a second orifice which is aligned relative to said second aperture and said second hole;

a second pin extending through said second aperture, said second orifice and said second hole for rotatably supporting said second spool between said first and second members;

said first spool defines a first slot;

said second spool defines a second slot;

said supporting tape including:

a first and a second polyester tape;

said first tape extending through said first slot of said first spool; and said second tape extending through said second slot of said second spool.

14. A mini blind apparatus comprising:

a first slat having a first and a second end and a front and a rear edge;

a second slat disposed spaced and parallel relative to said first slat, said second slat having a first and a second extremity and a front and a rear side;

a control mechanism connected to said slats for controlling movement of said slats;

a spaced disposition of said slats being selectively controlled by said control mechanism;

said control mechanism including:

a supporting polyester tape connected to said slats;

a first tab having a front and a rear end, said front end of said tab being secured to said rear edge of said first slat;

said first tab including:

a first member defining a first aperture and a second aperture disposed between said first aperture and said rear end of said tab;

a second member disposed spaced and parallel relative to said first member, said second member defining a first hole aligned relative to said first aperture and a second hole aligned relative to said second aperture and disposed between said first hole and said rear end of said tab;

a first spool disposed between said first aperture and said first hole, said first spool defining a first orifice which is aligned relative to said first aperture and said first hole;

a first pin extending through said first aperture, said first orifice and said first hole for rotatable supporting said first spool between said first and second members;

a second spool disposed between said second aperture and said second hole, said second spool defining a second orifice which is aligned relative to said second aperture and said second hole;

a second pin extending through said second aperture, said second orifice and said second hole for rotatable supporting said second spool between said first and second members;

said first spool defines a first slot;

said second spool defines a second slot;

said control mechanism including:

a first and a second polyester tape;

said first tape extending through said first slot of said first spool;

said second tape extending through said second slot of said second, spool;

said first spool includes:

a first cylindrical body which defines said first slot, said first body having a first and a second end;

said first slot extending diametrically through said first body transverse relative to said first orifice such that when said first tape extends through said first slot and said first pin is inserted through said first orifice, said first tape is wedged between said first pin and said first orifice;

said second spool includes:

a second cylindrical body which defines said second slot, said second body having a first and a second extremity;

said second slot extending diametrically through said second body transverse relative to said second orifice such that when said second tape extends through said second slot and said second pin is inserted through said second orifice, said second tape is wedged between said second pin and said second orifice;

said first orifice is serrated such that wedging of said first tape is enhanced;

said second orifice is serrated such that wedging of said second tape is enhanced;

said first spool further includes:

a first flange extending from said first end of said first body;

a second flange extending from said second end of said first body;

said second spool further includes:

a first annular extension extending from said first extremity of said second body;

a second annular extension extending from said second extremity of said second body;

said first pin has a first and a second end, said second end of said first pin defining a first point;

said second pin has a first and a second extremity, said second extremity of said second pin defining a second point, said arrangement being such that when said pins have been inserted in said orifices, said points are snipped off;

said pins are metal;

said slots are beveled at said ends thereof to facilitate threading therethrough of said tapes;

said first tab further includes:

a frangible spacer disposed adjacent to said rear end of said first tab, said spacer being removed from said first tab after said pins are inserted through said orifices; and said first and second spools define first and second flattened portions which are disposed diametrically opposite to each other in order to assist location of said spools during threading thereof.

* * * * *